US008052388B2

(12) United States Patent
McCaffrey et al.

(10) Patent No.: US 8,052,388 B2
(45) Date of Patent: Nov. 8, 2011

(54) GAS TURBINE ENGINE SYSTEMS INVOLVING MECHANICALLY ALTERABLE VANE THROAT AREAS

(75) Inventors: Michael G McCaffrey, Windsor, CT (US); Shankar S Magge, S. Windsor, CT (US); Joel H Wagner, Wethersfield, CT (US); Daniel R Sabatino, East Hampton, CT (US); Joseph Clayton Burge, Jupiter, FL (US)

(73) Assignee: United Technologies Corporation, Hartford, CT (US)

( * ) Notice: Subject to any disclaimer, the term of this patent is extended or adjusted under 35 U.S.C. 154(b) by 1013 days.

(21) Appl. No.: 11/947,160

(22) Filed: Nov. 29, 2007

(65) Prior Publication Data

US 2009/0142181 A1 Jun. 4, 2009

(51) Int. Cl.
*F03B 3/12* (2006.01)

(52) U.S. Cl. ..... 416/23; 416/24; 416/36; 416/42; 416/61; 416/97 R; 415/115; 415/119

(58) Field of Classification Search ..... 415/115, 415/119; 416/23, 24, 36, 42, 61, 97 R, DIG. 5
See application file for complete search history.

(56) References Cited

U.S. PATENT DOCUMENTS

| | | | | | |
|---|---|---|---|---|---|
| 2,545,010 | A * | 3/1951 | Stalker | 244/208 |
| 2,852,211 | A * | 9/1958 | Xenakis | 244/203 |
| 4,740,138 | A | 4/1988 | Zaehring et al. | |
| 4,856,962 | A | 8/1989 | McDow | |
| 5,209,438 | A * | 5/1993 | Wygnanski | 244/203 |
| 5,314,301 | A | 5/1994 | Knight | |
| 5,332,357 | A | 7/1994 | Tubbs | |
| 5,520,511 | A | 5/1996 | Loudet et al. | |
| 5,549,448 | A | 8/1996 | Langston | |
| 5,601,401 | A | 2/1997 | Matheny et al. | |
| 5,931,636 | A | 8/1999 | Savage et al. | |
| 6,033,180 | A * | 3/2000 | Machida | 416/23 |
| 6,203,269 | B1 * | 3/2001 | Lorber et al. | 415/115 |
| 6,267,331 | B1 * | 7/2001 | Wygnanski et al. | 244/204 |
| 6,461,105 | B1 | 10/2002 | Nicolson | |
| 2007/0048126 | A1 | 3/2007 | Schilling | |

* cited by examiner

*Primary Examiner* — Igor Kershteyn
(74) *Attorney, Agent, or Firm* — Carlson, Gaskey & Olds, P.C.

(57) ABSTRACT

Gas turbine engine systems involving mechanically alterable vane throat areas are provided. In this regard, a representative vane for a gas turbine engine includes: a leading edge; a trailing edge; a suction side surface extending between the leading edge and the trailing edge; a cavity having an aperture located in the suction side surface; and a barrel located within the cavity and being moveable therein such that movement of the barrel alters an extent to which the barrel protrudes through the aperture.

20 Claims, 2 Drawing Sheets

GAS TURBINE ENGINE SYSTEMS INVOLVING MECHANICALLY ALTERABLE VANE THROAT AREAS

BACKGROUND

1. Technical Field

The disclosure generally relates to gas turbine engines.

2. Description of the Related Art

Gas turbine engines use compressors to compress gas for combustion. In particular, a compressor typically uses alternating sets of rotating blades and stationary vanes to compress gas. Gas flowing through such a compressor is forced between the sets and between adjacent blades and vanes of a given set. Similarly, after combustion, hot expanding gas drives a turbine that has sets of rotating blades and stationary vanes.

SUMMARY

Gas turbine engine systems involving mechanically alterable vane throat areas are provided. In this regard, an exemplary embodiment of a vane for a gas turbine engine comprises: a leading edge; a trailing edge; a suction side surface extending between the leading edge and the trailing edge; a cavity having an aperture located in the suction side surface; and a barrel located within the cavity and being moveable therein such that movement of the barrel alters an extent to which the barrel protrudes through the aperture.

An exemplary embodiment of a vane assembly for a gas turbine engine comprises: a vane having a pressure side; and an adjacent vane having a suction side located adjacent to the pressure side, the vane and the adjacent vane defining a throat area therebetween, the suction side of the adjacent vane having a cavity and a barrel retained by the cavity, the barrel being moveable such that movement of the barrel alters the throat area.

An exemplary embodiment of a gas turbine engine comprises: a vane assembly having a vane and an adjacent vane; the vane having a pressure side; and the adjacent vane having a suction side located adjacent to the pressure side, the vane and the adjacent vane defining a throat area therebetween, the suction side of the adjacent vane having a cavity and a barrel retained by the cavity, the barrel being moveable such that movement of the barrel alters the throat area.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Gas turbine engine systems involving mechanically alterable vane throat areas are provided, several exemplary embodiments of which will be described in detail. In some embodiments, a throat area between adjacent vanes is altered by moving a barrel located on a suction side of one of the vanes. The barrel is rotatable such that an exterior of the barrel can mechanically alter the throat area between the adjacent vanes. In some embodiments, one or more fluidic jets can be used to additionally alter the throat area and/or modify flow characteristics of the gas flow path in a vicinity of the barrel.

Figure 1:
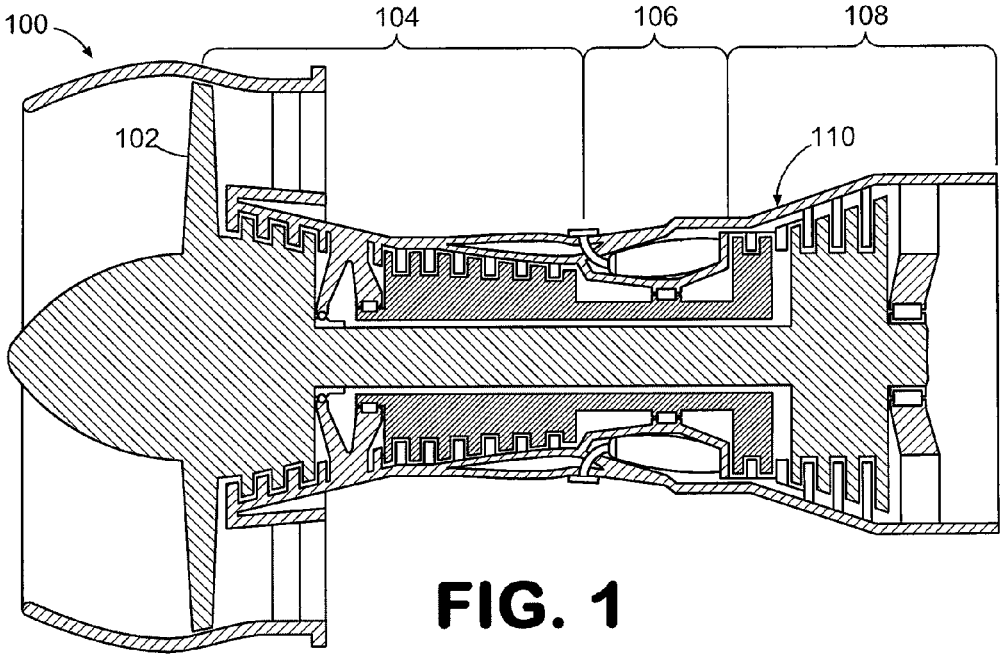
FIG. 1 is a schematic diagram depicting an exemplary embodiment of a gas turbine engine.

In this regard, reference is made to the schematic diagram of FIG. 1, which depicts an exemplary embodiment of a gas turbine engine. As shown in FIG. 1, engine 100 incorporates a fan 102, a compressor section 104, a combustion section 106 and a turbine section 108. Notably, turbine section 108 incorporates a variable vane assembly 110, which will be described in greater detail with respect to FIG. 2. Although depicted in FIG. 1 is a turbofan gas turbine engine, there is no intention to limit the concepts described herein to use with turbofans, as various other types of gas turbine engines can be used.

Figure 2:
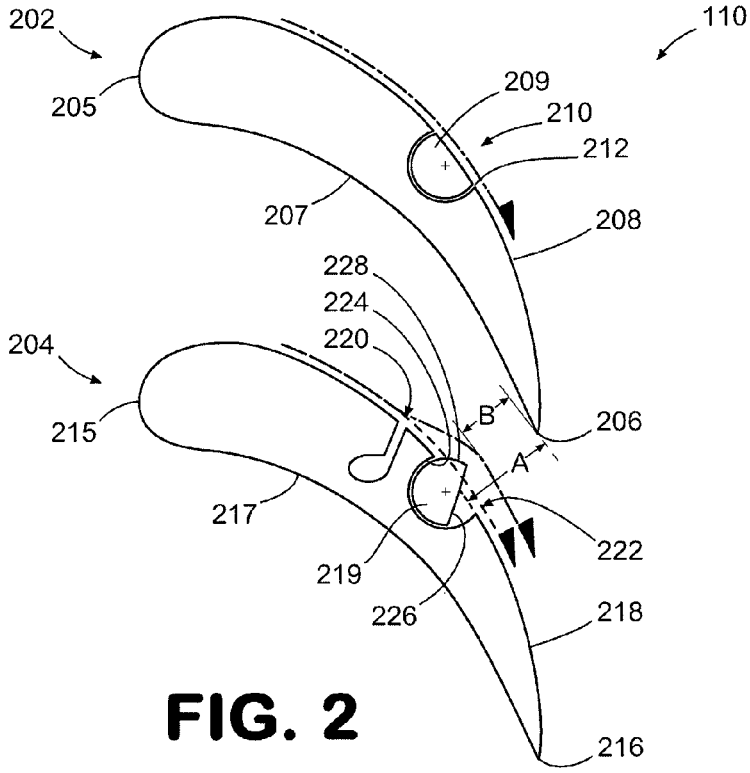
FIG. 2 is a schematic diagram depicting adjacent vanes of the turbine section of the embodiment of FIG. 1.

Two adjacent vanes of the vane assembly 110 are depicted schematically in FIG. 2. Specifically, vanes 202 and 204 are stationary vanes that are spaced from each other to define a throat area (A) that is defined as the narrowest region between the vanes. Vane 202 includes a leading edge 205, a trailing edge 206, a pressure side 207 and a suction side 208, forming a radially extending airfoil. Along the suction side, a moveable (e.g., rotatable) barrel 209 is positioned. In particular, a cavity 210 includes an aperture 212 that is located in the suction side. The barrel is positioned within the cavity and is moveable therein about its radial axis.

Similarly, vane 204 includes a leading edge 215, a trailing edge 216, a pressure side 217 and a suction side 218. Vane 204 also incorporates a moveable (e.g., rotatable) barrel 219, as well as a fluidic jet 220. In particular, a cavity 222 includes an aperture 224 that is located in the suction side 218. The barrel 219 is positioned within the cavity and is moveable therein.

In at least some positions, at least a portion of the barrel 219 extends through the aperture 224 and outwardly from the suction side 218. Specifically, in a first position (depicted by the dashed lines), a surface 226 of the barrel is generally flush with the suction side 218. Correspondingly, the throat area (A) is created by surface 207 and either surface 218 or 226, depending on which surface (218 or 226) is closest to surface 207. However, in a second position, portion 228 of the barrel protrudes outwardly from the suction side, thereby mechanically altering the throat area (B).

In the embodiment of FIG. 2, fluidic jet 220 of vane 204 can be operated to control the flow upstream of the portion 228 of the barrel protruding from surface 218. The fluidic jet is positioned and angled with respect to surface 218 to control the incoming, near surface, boundary layer to prevent flow separation immediately upstream and downstream of the protruding barrel portion 228.

The fluidic jet energizes the near surface flow by imparting flow momentum to the flow between vanes 202 and 204 and through the throat area (B), thereby preventing flow separation from surface 218 and the associated losses accompanying flow separation.

Figure 3A:
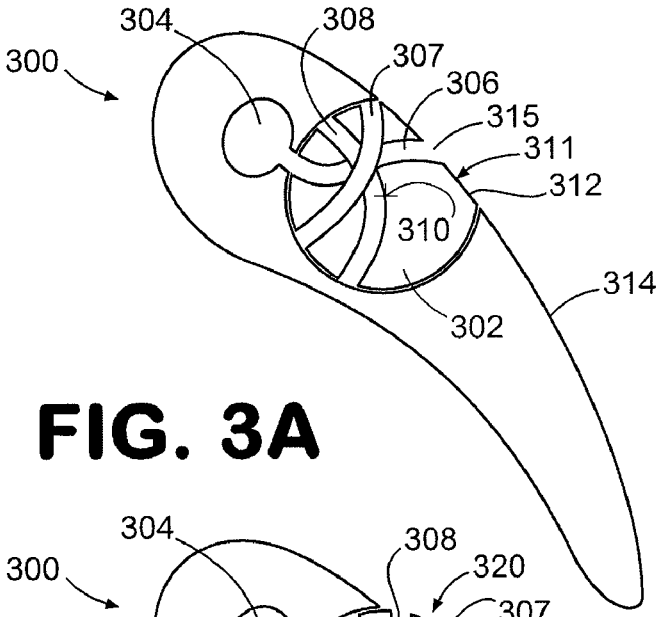
FIGS. 3A-3C depict an exemplary embodiment of a variable vane, with a barrel of the vane being shown rotated to different positions.
Figure 3B:
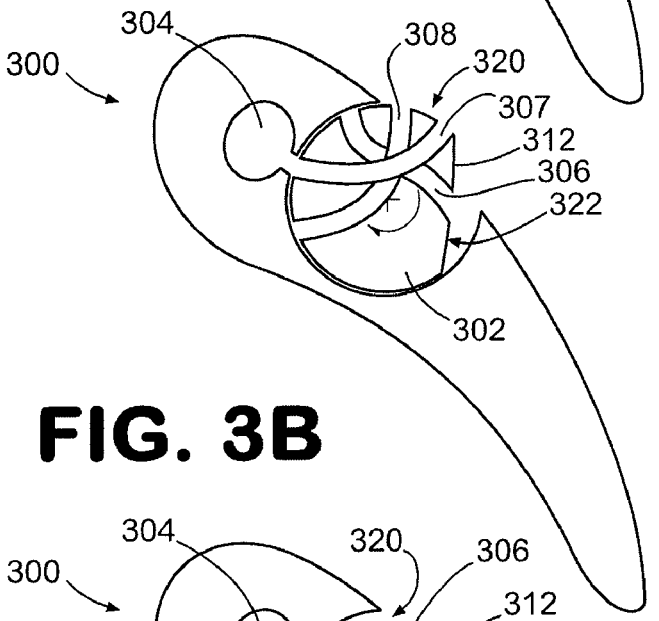
Figure 3C:
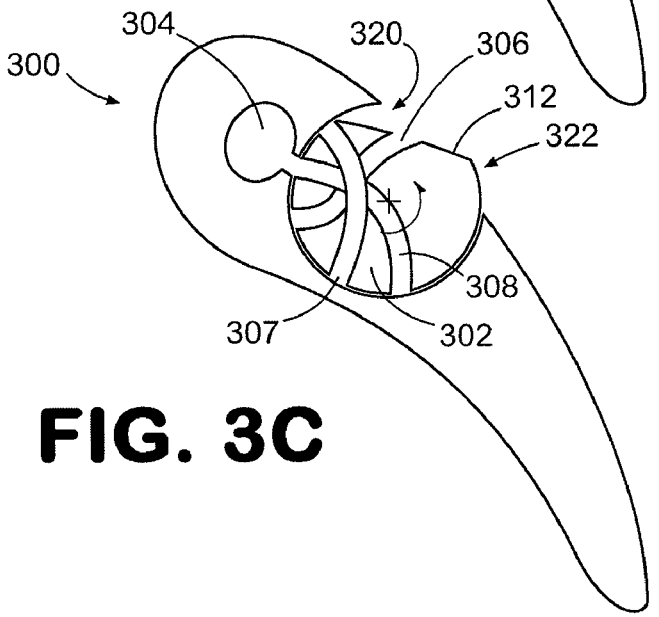

As shown in FIGS. 3A-3C, another embodiment of a variable vane is schematically depicted. As shown in FIG. 3A, vane 300 incorporates a barrel 302 that includes multiple channels that communicate with an interior plenum 304 of the vane. The plenum receives a flow of air, for example from compressor 104 (FIG. 1), that can be used to form fluidic jets. In this embodiment, three non-communicating channels 306, 307 and 308 are depicted.

Barrel 302 is generally a cylindrical structure that extends along a longitudinal axis 310 within a cavity 311 between a root and a tip of the vane. As shown in FIG. 3A, barrel 302 is oriented in a first or neutral position, in which a surface 312 of the barrel is generally flush with a suction side surface 314 of the vane. In the neutral position, channel 306 pneumatically communicates with the plenum. As such, air from the plenum can be directed (e.g., continuously or intermittently) through the channel 306 and into the gas flow path located between the suction side surface and the pressure side surface of an adjacent vane (not shown). It should be noted that, in other embodiments, one or more positions of the barrel, such as the neutral position, can correspond to no channels communicating with a plenum. Also, multiple channels 306 may extend from root to tip along the longitudinal axis.

In contrast, FIG. 3B depicts the barrel rotated to a second position, in which the surface 312 of the barrel is no longer flush with the suction side surface. Specifically, a portion 320 of the barrel now protrudes from the suction side surface, whereas another portion 322 of the barrel is positioned within the cavity. Additionally, in the second position, channel 307 pneumatically communicates with the plenum, thereby enabling air to be directed through channel 307. It should be noted that in this embodiment, when air is being directed into channel 307, air is no longer being directed into another channel. In other embodiments, however, air can be provided to multiple channels simultaneously.

In FIG. 3C, the barrel is rotated to a third position, in which the surface 312 of the barrel is not flush with the suction side surface. Specifically, portion 322 of the barrel protrudes from the suction side surface, with portion 320 of the barrel being positioned within the cavity. Additionally, in the third position, channel 308 pneumatically communicates with the plenum, thereby enabling air to be directed through channel 308.

Notably, air can be provided from the plenum and through a channel of sufficient volume and pressure to form a fluidic jet at the outlet of the channel. In some embodiments, a fluidic jet can be used to augment the gas flow path in a vicinity of the barrel in order to reduce a potential for flow separation from the suction side surface. Additionally or alternatively, a fluidic jet can be used to influence the throat area directly, such as by repositioning the streamline flow in a vicinity of the fluidic jet. As an example, the embodiment of FIGS. 3A-3C can be used to modify the throat area mechanically (using the barrel) and fluidicly (using a fluidic jet from an outlet of a channel).

In some embodiments, a fluidic jet can be controlled independently of positioning of the barrel such that communication of the channel with the plenum does not necessarily dictate whether air is provided from the plenum to the channel. It should also be noted that in some embodiments, two or more of the channels can communicate with each other such that air provided by the plenum to one of the channels can be emitted by outlets of multiple channels. This is in contrast to the independent channel arrangement of the embodiment of FIGS. 3A-3C.

Actuation of a barrel between various positions can be accomplished in various manners. By way of example, trunnions, arms, and/or synchronization rings can be used, with actuation occurring either internal or external to the engine casing. As another example, a gear-driven arrangement can be used. In some embodiments, a barrel can be mounted to a vane assembly, in which the vane associated with the barrel can be either stationary or moveable.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A vane for a gas turbine engine comprising:
a leading edge;
a trailing edge;
a suction side surface extending between the leading edge and the trailing edge;
a cavity having an aperture located in the suction side surface;
a barrel located within the cavity and being moveable therein such that movement of the barrel alters an extent to which the barrel protrudes through the aperture; and
a fluidic jet having an outlet port operative to emit gas into a gas flow path located adjacent to the suction side surface.

2. The vane of claim 1, wherein the outlet port of the fluidic jet is positioned upstream of the barrel.

3. The vane of claim 1, wherein the outlet port of the fluidic jet is moveable with the barrel.

4. The vane of claim 3, wherein the outlet port is a first of multiple outlet ports moveable with the barrel.

5. The vane of claim 4, wherein at least two of the outlet ports are located at different radial positions with respect to a rotational axis of the barrel.

6. The vane of claim 1, wherein the barrel is rotatable through a range of positions, with a first of the positions corresponding to a portion of the exterior surface of the barrel being flush with the suction side surface.

7. The vane of claim 6, wherein a second of the positions corresponds to the portion of the exterior surface of the barrel protruding from the aperture.

8. The vane of claim 6, wherein:
the barrel mounts an outlet port of a fluidic jet;
in a second position, the outlet port is not positioned to emit gas into a gas flow path located adjacent to the suction side surface; and
in a third of the positions, the outlet port is positioned to emit gas into the gas flow path.

9. The vane of claim 1, wherein:
the vane further comprises a plenum pneumatically communicating with the cavity;
the barrel has a channel extending between an inlet and an outlet, the barrel being selectively moveable between a first position, in which the inlet is aligned with the plenum such that gas from the plenum is directed through the channel and out of the outlet and, a second position, in which the inlet is not aligned with the plenum.

10. The vane of claim 1, wherein the vane is a stationary vane.

11. A vane assembly for a gas turbine engine comprising:
a vane having a pressure side; and
an adjacent vane having a suction side located adjacent to the pressure side, the vane and the adjacent vane defining a throat area therebetween, the suction side of the adjacent vane having a cavity and a barrel retained by the cavity, the barrel being moveable such that movement of the barrel alters the throat area.

12. The vane assembly of claim 11, wherein:
the barrel is a first barrel; and the vane has a suction side and a second barrel located adjacent to the suction side of the vane.

13. The vane assembly of claim 11, further comprising a fluidic jet having an outlet port operative to emit gas into a gas flow path located between the vane and the adjacent vane.

14. The vane assembly of claim 11, wherein a fluidic jet is operative to alter the throat area.

15. The vane assembly of claim 11, wherein a fluidic jet is.

16. The vane assembly of claim 11, wherein a barrel is a rotatable barrel operative to rotate about a rotational axis.

17. The vane assembly of claim 11, wherein the barrel lacks rotational symmetry.

18. A gas turbine engine comprising:

a vane assembly having a vane and an adjacent vane;

the vane having a pressure side; and the adjacent vane having a suction side located adjacent to the pressure side, the vane and the adjacent vane defining a throat area therebetween, the suction side of the adjacent vane having a cavity and a barrel retained by the cavity, the barrel being moveable such that movement of the barrel alters the throat area.

19. The engine of claim 18, wherein the engine is a turbofan gas turbine engine.

20. The engine of claim 18, wherein the vane assembly is a high pressure turbine vane assembly.

* * * * *

UNITED STATES PATENT AND TRADEMARK OFFICE

CERTIFICATE OF CORRECTION

PATENT NO. : 8,052,388 B2
APPLICATION NO. : 11/947160
DATED : November 8, 2011
INVENTOR(S) : Michael G. McCaffrey et al.

It is certified that error appears in the above-identified patent and that said Letters Patent is hereby corrected as shown below:

Claim 15, Column 5, line 8: insert --movable with the barrel-- between "is" and "."

Signed and Sealed this
Twenty-first Day of February, 2012

David J. Kappos

David J. Kappos
*Director of the United States Patent and Trademark Office*